US008931212B2

(12) United States Patent
Weder

(10) Patent No.: US 8,931,212 B2
(45) **Date of Patent: *Jan. 13, 2015**

(54) METHOD FOR WRAPPING A FLORAL GROUPING

(71) Applicant: Wanda M. Weder and William F. Straeter, not individually by solely as Trustees of The Family Trust U/T/A, Highland, IL (US)

(72) Inventor: Donald E. Weder, Highland, IL (US)

(73) Assignee: Wanda M. Weder & William F. Straeter, Highland, IL (US), not individually but solely as Trustees of The FamilyTrust U/T/A dated 12/8/1995

( * ) Notice: Subject to any disclaimer, the term of this patent is extended or adjusted under 35 U.S.C. 154(b) by 0 days.

This patent is subject to a terminal disclaimer.

(21) Appl. No.: 13/965,344

(22) Filed: Aug. 13, 2013

(65) Prior Publication Data

US 2013/0326943 A1 Dec. 12, 2013

Related U.S. Application Data

(60) Continuation of application No. 13/598,249, filed on Aug. 29, 2012, now Pat. No. 8,533,994, which is a continuation of application No. 13/309,632, filed on Dec. 2, 2011, now abandoned, which is a division of application No. 12/962,092, filed on Dec. 7, 2010, now Pat. No. 8,091,273, which is a continuation of application No. 12/699,688, filed on Feb. 3, 2010, now abandoned, which is a continuation of application No. 11/490,353, filed on Jul. 20, 2006, now abandoned.

(51) Int. Cl.

| | |
|---|---|
| ***A01G 9/02*** | (2006.01) |
| ***B65B 25/02*** | (2006.01) |
| ***B65D 85/50*** | (2006.01) |

(52) U.S. Cl.

CPC ..... *B65D 85/505* (2013.01); *B65B 25/023* (2013.01)

USPC ..... 47/72

(58) Field of Classification Search

USPC ..... 47/72, 41.01

See application file for complete search history.

(56) References Cited

U.S. PATENT DOCUMENTS

| | | | |
|---|---|---|---|
| 732,889 | A | 7/1903 | Paver |
| 890,903 | A | 6/1908 | Hawley |

(Continued)

FOREIGN PATENT DOCUMENTS

| | | |
|---|---|---|
| AU | 4231978 | 6/1979 |
| BE | 654427 | 5/1982 |

(Continued)

OTHER PUBLICATIONS

Chantler & Chantler brochure showing Zipper Sleeve™ and Florasheet®, Date unknown, 2 pages.

(Continued)

*Primary Examiner* — Monica Williams

(74) *Attorney, Agent, or Firm* — Dunlap Codding, P.C.

(57) ABSTRACT

A floral grouping package for a floral grouping having a bloom end and a stem end is disclosed. A wrapper is formed from a sheet of material or bag which is wrapped about at least a portion of the stem end of the floral grouping. The wrapped floral grouping is then positioned within a receiving space of a preformed sleeve whereby the wrapper is secured in a stable position about at least a portion of the stem end of the floral grouping by the preformed sleeve. A detaching element defines the detachable upper portion and a lower portion of the preformed sleeve so that the upper portion can be removed from the lower portion.

15 Claims, 4 Drawing Sheets

(56) References Cited

U.S. PATENT DOCUMENTS

| | | | |
|---|---|---|---|
| 1,270,554 | A | 6/1918 | Rubei |
| 1,446,563 | A | 2/1923 | Hughes |
| 2,200,111 | A | 5/1940 | Bensel |
| 2,278,673 | A | 4/1942 | Savada et al. |
| 2,323,287 | A | 7/1943 | Amberg |
| 2,529,060 | A | 11/1950 | Trillich |
| 2,774,187 | A | 12/1956 | Smithers |
| 2,846,060 | A | 8/1958 | Yount |
| 2,850,842 | A | 9/1958 | Eubank, Jr. |
| 3,271,922 | A | 9/1966 | Wallerstein et al. |
| 3,376,666 | A | 4/1968 | Leonard |
| 3,380,646 | A | 4/1968 | Doyen et al. |
| 3,508,372 | A | 4/1970 | Wallerstein et al. |
| 3,512,700 | A | 5/1970 | Evans et al. |
| 3,552,059 | A | 1/1971 | Moore |
| 3,556,389 | A | 1/1971 | Gregoire |
| 3,767,104 | A | 10/1973 | Backman et al. |
| 4,091,925 | A | 5/1978 | Griffo et al. |
| 4,189,868 | A | 2/1980 | Tymchuck et al. |
| 4,216,620 | A | 8/1980 | Weder et al. |
| 4,297,811 | A | 11/1981 | Weder |
| 4,333,267 | A | 6/1982 | Witte |
| 4,347,686 | A | 9/1982 | Wood |
| 4,400,910 | A | 8/1983 | Koudstaal et al. |
| 4,413,725 | A | 11/1983 | Bruno et al. |
| 4,733,521 | A | 3/1988 | Weder et al. |
| 4,773,182 | A | 9/1988 | Weder et al. |
| 4,801,014 | A | 1/1989 | Meadows |
| 4,835,834 | A | 6/1989 | Weder |
| D301,991 | S | 7/1989 | Van Sant |
| 4,941,572 | A | 7/1990 | Harris |
| 5,073,161 | A | 12/1991 | Weder et al. |
| 5,074,675 | A | 12/1991 | Osgood |
| 5,105,599 | A | 4/1992 | Weder |
| 5,111,638 | A | 5/1992 | Weder |
| 5,120,382 | A | 6/1992 | Weder |
| 5,152,100 | A | 10/1992 | Weder et al. |
| 5,181,364 | A | 1/1993 | Weder |
| 5,199,242 | A | 4/1993 | Weder et al. |
| 5,205,108 | A | 4/1993 | Weder et al. |
| 5,228,234 | A | 7/1993 | de Klerk et al. |
| 5,235,782 | A | 8/1993 | Landau |
| 5,239,775 | A | 8/1993 | Landau |
| 5,259,106 | A | 11/1993 | Weder et al. |
| 5,307,605 | A | 5/1994 | Straeter |
| 5,307,606 | A | 5/1994 | Weder |
| 5,311,991 | A | 5/1994 | Weder et al. |
| 5,335,475 | A | 8/1994 | Weder |
| 5,335,476 | A | 8/1994 | Weder |
| 5,335,477 | A | 8/1994 | Weder |
| 5,339,601 | A | 8/1994 | Weder |
| 5,353,575 | A | 10/1994 | Stepanek |
| 5,361,482 | A | 11/1994 | Weder et al. |
| 5,363,592 | A | 11/1994 | Weder et al. |
| 5,388,695 | A | 2/1995 | Gilbert |
| 5,443,670 | A | 8/1995 | Landau |
| 5,493,809 | A | 2/1996 | Weder et al. |
| D368,025 | S | 3/1996 | Sekerak et al. |
| 5,496,251 | A | 3/1996 | Cheng |
| 5,496,252 | A | 3/1996 | Gilbert |
| 5,501,059 | A | 3/1996 | Weder et al. |
| 5,509,188 | A | 4/1996 | Weder et al. |
| 5,526,932 | A | 6/1996 | Weder |
| 5,560,488 | A | 10/1996 | Weder |
| 5,572,826 | A | 11/1996 | Weder |
| 5,572,851 | A | 11/1996 | Weder |
| 5,575,133 | A | 11/1996 | Weder et al. |
| 5,595,045 | A | 1/1997 | Weder et al. |
| 5,617,703 | A | 4/1997 | Weder |
| 5,623,809 | A | 4/1997 | Weder |
| 5,624,320 | A | 4/1997 | Martinez |
| 5,647,168 | A | 7/1997 | Gilbert |
| 5,664,403 | A | 9/1997 | Weder et al. |
| 5,687,502 | A | 11/1997 | Weder |
| 5,758,772 | A | 6/1998 | Weder et al. |
| 5,890,592 | A | 4/1999 | Weder et al. |
| 6,105,771 | A | 8/2000 | Weder et al. |
| 6,119,860 | A | 9/2000 | Weder |
| 6,123,194 | A | 9/2000 | Weder et al. |
| 6,138,828 | A | 10/2000 | Bendix |
| 8,091,273 | B2 * | 1/2012 | Weder ..... 47/41.01 |
| 8,091,274 | B2 * | 1/2012 | Weder ..... 47/41.01 |
| 8,397,430 | B2 * | 3/2013 | Weder ..... 47/72 |
| 8,533,994 | B2 * | 9/2013 | Weder ..... 47/72 |
| 2008/0016763 | A1 | 1/2008 | Weder |
| 2010/0132256 | A1 | 6/2010 | Weder |
| 2011/0072717 | A1 | 3/2011 | Weder |
| 2012/0073244 | A1 | 3/2012 | Weder |

FOREIGN PATENT DOCUMENTS

| | | |
|---|---|---|
| CN | 560532 | 4/1975 |
| DE | 345464 | 12/1921 |
| DE | 513971 | 11/1930 |
| DE | 1166692 | 5/1962 |
| DE | 1962947 | 6/1971 |
| DE | 2060812 | 11/1971 |
| DE | 2748626 | 5/1979 |
| DE | 2948265 | 11/1979 |
| DE | 3445799 | 6/1986 |
| DE | 3829281 | 5/1989 |
| DE | 8905250 | 10/1989 |
| DE | 3911847 | 10/1990 |
| DE | 299524 | 4/1992 |
| EP | 0050990 | 5/1982 |
| EP | 0791543 | 8/1997 |
| FR | 1376047 | 9/1964 |
| FR | 2036163 | 12/1970 |
| FR | 2137325 | 12/1972 |
| FR | 2272914 | 12/1975 |
| FR | 2489126 | 3/1982 |
| FR | 2603159 | 3/1988 |
| FR | 2610604 | 8/1988 |
| FR | 2619698 | 3/1989 |
| GB | 1204647 | 9/1970 |
| GB | 2056410 | 3/1981 |
| GB | 2074542 | 11/1981 |
| GB | 2128083 | 4/1984 |
| GB | 2252708 | 8/1992 |
| IT | 224507 | 4/1996 |
| JP | 4158036 | 6/1992 |
| JP | 542958 | 2/1993 |
| NL | 8301709 | 12/1984 |
| NL | 1000658 | 3/1996 |
| WO | WO9315979 | 8/1993 |
| WO | WO2004074135 | 9/2004 |

OTHER PUBLICATIONS

"Color Them Happy with Highlander Products" © 1992.
"Super Seller", Supermarket Floral, Sep. 15, 1992.
"Costa Keeps the Christmas Spirit", Supermarket Floral, Sep. 15, 1992.
"Now More Than Ever", Supermarket Floral, Sep. 15, 1992.
"Halloween", Link Magazine, Sep. 1992, 2 pages.
"Speed Sheets and Speed Rolls" Brochure, Highland Supply Corporation, © 1990.
Le Plant Sac Advertisement, published prior to Sep. 26, 1987.
"A World of Cut Flower and Pot Plant Packaging" Brochure, Klerk's Plastic Products Manufacturing, Inc., Date unknown, 6 pages.
"Derwent Abstract" of FR 2610604A. It is noted that the abstract is an incorrect English translation of the contents of the French patent. The French patent does not enable or disclose adhesively attaching the covering to the container. 1988.
D-Bros Vinyl Vase; Item# 804F-ST, 804F-SP, 2 vases in different colors, Feb. 2004.

* cited by examiner

METHOD FOR WRAPPING A FLORAL GROUPING

CROSS REFERENCE TO RELATED APPLICATIONS/INCORPORATION BY REFERENCE STATEMENT

This application is a continuation of Ser. No. 13/598,249, filed Aug. 29, 2012, now U.S. Pat. No. 8,533,994, issued Sep. 17, 2013; which is a continuation of U.S. Ser. No. 13/309,632, filed Dec. 2, 2011, now abandoned; which is a divisional of U.S. Ser. No. 12/962,092, filed Dec. 7, 2010, now U.S. Pat. No. 8,091,273, issued Jan. 10, 2012; which is a continuation of U.S. Ser. No. 12/699,688, filed Feb. 3, 2010, now abandoned; which is a continuation of U.S. Ser. No. 11/490,353, filed Jul. 20, 2006, now abandoned. The entire contents of each of the above-referenced patents and patent applications are hereby expressly incorporated herein by reference.

DETAILED DESCRIPTION

Figure 1:
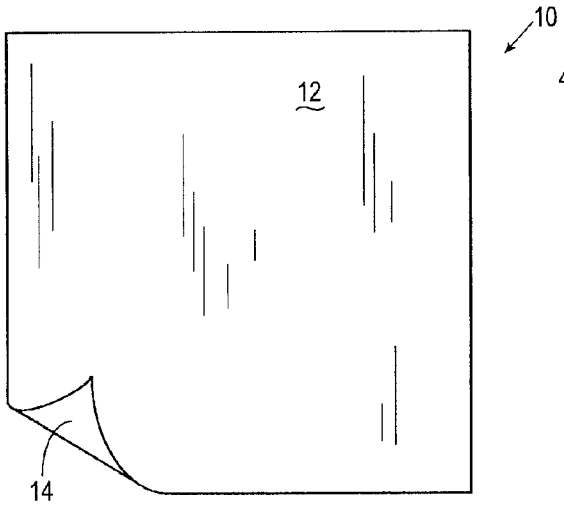
FIG. 1 is a top plan view of a sheet of material having a substantially square-shaped configuration used for wrapping a floral grouping, one corner of the sheet of material being upwardly turned to show a lower surface of the sheet of material.

Before explaining at least one embodiment of the presently disclosed and claimed inventive concept(s) in detail, it is to be understood that the presently disclosed and claimed inventive concept(s) is not limited in its application to the details of construction and the arrangement of the components or steps or methodologies set forth in the following description or illustrated in the drawings. The presently disclosed and claimed inventive concept(s) is capable of other embodiments or of being practiced or carried out in various ways. Also, it is to be understood that the phraseology and terminology employed herein is for the purpose of description and should not be regarded as limiting.

Unless otherwise defined herein, technical terms used in connection with the presently disclosed and claimed inventive concept(s) shall have the meanings that are commonly understood by those of ordinary skill in the art. Further, unless otherwise required by context, singular terms shall include pluralities and plural terms shall include the singular.

All patents, published patent applications, and non-patent publications mentioned in the specification are indicative of the level of skill of those skilled in the art to which this presently disclosed and claimed inventive concept(s) pertains. All patents, published patent applications, and non-patent publications referenced in any portion of this application are herein expressly incorporated by reference in their entirety to the same extent as if each individual patent or publication was specifically and individually indicated to be incorporated by reference.

All of the articles and/or methods disclosed and claimed herein can be made and executed without undue experimentation in light of the present disclosure. While the articles and methods of the presently disclosed and claimed inventive concept(s) have been described in terms of preferred embodiments, it will be apparent to those of skill in the art that variations may be applied to the articles and/or methods and in the steps or in the sequence of steps of the method described herein without departing from the concept, spirit and scope of the presently disclosed and claimed inventive concept(s). All such similar substitutes and modifications apparent to those skilled in the art are deemed to be within the spirit, scope and concept of the presently disclosed and claimed inventive concept(s) as defined by the appended claims.

As utilized in accordance with the present disclosure, the following terms, unless otherwise indicated, shall be understood to have the following meanings:

The use of the word "a" or "an" when used in conjunction with the term "comprising" in the claims and/or the specification may mean "one," but it is also consistent with the meaning of "one or more," "at least one," and "one or more than one". The use of the term "or" in the claims is used to mean "and/or" unless explicitly indicated to refer to alternatives only or the alternatives are mutually exclusive, although the disclosure supports a definition that refers to only alternatives and "and/or". Throughout this application, the term "about" is used to indicate that a value includes the inherent variation of error for the device, the method being employed to determine the value, or the variation that exists among the study subjects. For example but not by way of limitation, when the term "about" is utilized, the designated value may vary by plus or minus twelve percent, or eleven percent, or ten percent, or nine percent, or eight percent, or seven percent, or six percent, or five percent, or four percent, or three percent, or two percent, or one percent. The use of the term "at least one" will be understood to include one as well as any quantity more than one, including but not limited to, 2, 3, 4, 5, 10, 15, 20, 30, 40, 50, 100, etc. The term "at least one" may extend up to 100 or 1000 or more, depending on the term to which it is attached; in addition, the quantities of 100/1000 are not to be considered limiting, as higher limits may also produce satisfactory results. In addition, the use of the term "at least one of X, Y and Z" will be understood to include X alone, Y alone, and Z alone, as well as any combination of X, Y and Z. The use of ordinal number terminology (i.e., "first", "second", "third", "fourth", etc.) is solely for the purpose of differentiating between two or more items and is not meant to imply any sequence or order or importance to one item over another or any order of addition, for example.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, MB, BBC, AAABCCCC, CBBAAA, CABABB, and so forth. The skilled artisan will understand that typically there is no limit on the number of items or terms in any combination, unless otherwise apparent from the context.

As used herein, the term "substantially" means that the subsequently described event or circumstance completely occurs or that the subsequently described event or circumstance occurs to a great extent or degree. For example, the term "substantially" means that the subsequently described event or circumstance occurs at least 90% of the time, or at least 95% of the time, or at least 98% of the time.

The presently disclosed and claimed inventive concept(s) relates generally to a method for wrapping a floral grouping whereby a floral grouping is wrapped with a wrapper and the wrapper is secured about the floral grouping with a sleeve which frictionally engages the wrapper. The sleeve is provided with a detaching element which defines a detachable upper portion and a lower portion and the lower portion of the sleeve remains about the wrapper to secure the wrapper about the floral grouping when the detachable upper portion of the sleeve is removed.

The term "floral grouping" as used herein refers to a single flower having a bloom end and a stem end, a plurality of flowers at least a portion of which have a bloom end and a stem end, foliage, botanical items, propagules, cut flowers, artificial flowers and/or other fresh and/or artificial plants or floral materials, including secondary plants and/or other ornamentation which adds to the synthetic qualities of the overall floral grouping.

The term "botanical item" when used herein means a natural or artificial herbaceous or woody plant, taken singly or in combination. The term "botanical item" also means any portion or portions of natural or artificial herbaceous or woody plants including stems, leaves, flowers, blossoms, buds, blooms, cones, or roots, taken singly or in combination, or in groupings of such portions such as bouquet or floral grouping.

The term "propagule" when used herein means any structure capable of being propagated or acting as an agent of reproduction including seeds, shoots, stems, runners, tubers, plants, leaves, roots or spores.

The term "polymeric film" as used herein refers to a film formed of synthetic polymers, such as polypropylene or naturally occurring polymers such as cellophane, which are relatively strong and not subject to tearing (substantially non-tearable). Various types of "polymeric films" are described in U.S. Pat. No. 5,311,991, issued to Weder et al. on May 17, 1994, the contents of which are hereby expressly incorporated herein by reference.

The term "floral sleeve or sleeve" when used herein is initially a flexible, flat, collapsed piece of material which is openable to the form of a preformed tube or sleeve. The sleeve may have a closed lower end or an open lower end and may be tapered outwardly from the lower end towards a larger diameter and its upper end so as to be substantially frusto-conical when opened.

The term "detaching element" as used herein means any element or combination of elements, which enable the tearing away or detachment of one object or portion of an object from another object or portion of an object.

Figure 2:
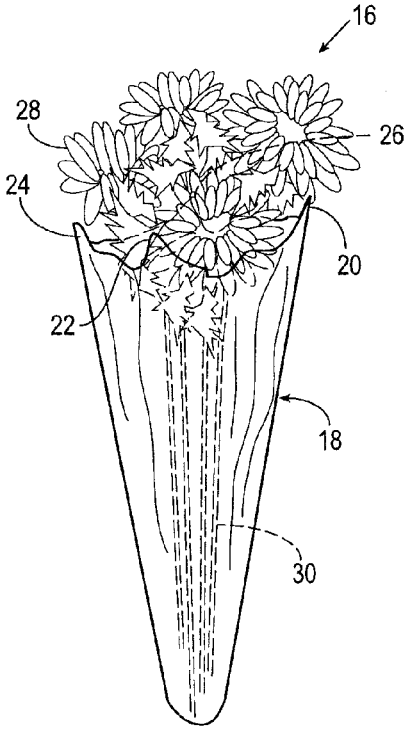
FIG. 2 is a pictorial representation of a floral group having a wrapper formed thereabout from the sheet of material of FIG. 1.

Referring now to the drawings, and more particularly to FIG. 1, shown therein is a sheet of material 10 having an upper surface 12 and a lower surface 14. The sheet of material 10, which is shown as having a substantially square-shaped configuration, is sized so that the sheet of material 10 can be wrapped about a floral grouping 16 to form a wrapper or cover 18 about the floral grouping 16 substantially as shown in FIG. 2. When employing a substantially square-shaped sheet of material 10 to form the wrapper 18, the wrapper 18 so formed is provided with four petal-like portions 20, 22, 24 and 26, each of which terminates with a substantially pointed end formed by the four corners of the substantially square-shaped sheet of material 10.

The floral grouping 16 about which the sheet of material 10 is wrapped to form the wrapper 18 is provided with a bloom end 28 and a stem end 30. The sheet of material 10 is desirably wrapped about the stem end 30 of the floral grouping 16 such that the four petal-like portions 20, 22, 24 and 26 are flared upwardly and outwardly about the bloom end 28 substantially as shown.

The sheet of material 10 used to form the wrapper 18 can be fabricated of any material having sufficient flexibility and structural integrity to enable one to form the wrapper 18 about the floral grouping 16. Further, the sheet of material 10 employed in the construction of the wrapper 18 will desirably have a substantially planar cross-section and desirably have a thickness from about 0.1 mil to about 30 mil, and more desirably from about 1 mil to about 10 mil. However, it should be understood that the thickness of the sheet of material 10 may vary depending on the type of material from which the sheet of material 10 is constructed, the only requirement being that the sheet of material 10 be capable of being wrapped about the floral grouping 16 to form the wrapper 18. That is, it should be understood that the sheet of material 10 can have any thickness as long as the sheet of material 10 retains sufficient flexibility and foldability so that the sheet of material 10 can be formed about the floral grouping 16 to provide the wrapper 18. For example, the sheet of material 10 can be constructed of paper (untreated and treated in any manner), metal foil, polymeric film, fabric (woven, non-woven, synthetic, or natural), cardboard, fiber, cloth, burlap or laminations, and combinations thereof.

If desired, a decorative pattern, such as a color and/or an embossed pattern and/or a hologram and/or other decorative surface ornamentation may be applied to the upper and/or lower surfaces 12 and 14 of the sheet of material 10 or portions thereof, including but not limited to, printed designs, embossed designs, coatings, colors, flocking, or metallic finishes. Further, the sheet of material 10 may be totally clear or partially clear or a tinted transparent material.

Although the sheet of material 10 has been shown and described herein as having a substantially square-shaped configuration, it should also be understood that the sheet of material 10 may assume any geometric, non-geometric, asymmetrical or fanciful shape having any appropriate size so long as the sheet of material 10 can be disposed about the floral grouping 16 to form the wrapper 18. While the wrapper 18 has been described as being formed of one sheet of material 10, it should be understood that the wrapper 18 can be formed of two or more sheets of material 10. In addition, when employing two or more sheets of material 10 to form the wrapper 18 about the floral grouping 16, the configuration of the sheets of material 10 may vary depending on the overall design desired for the wrapper 18. For example, when using two sheets of material 10 to form the wrapper 18, the sheets of material 10 can have the same configuration, such as a square-shaped configuration, or the two sheets of material 10 can have different configurations, such as a square-shaped configuration and a rectangular-shaped configuration, and if desired, the two sheets of material 10 can be oriented differently relative to one another.

Figure 3:
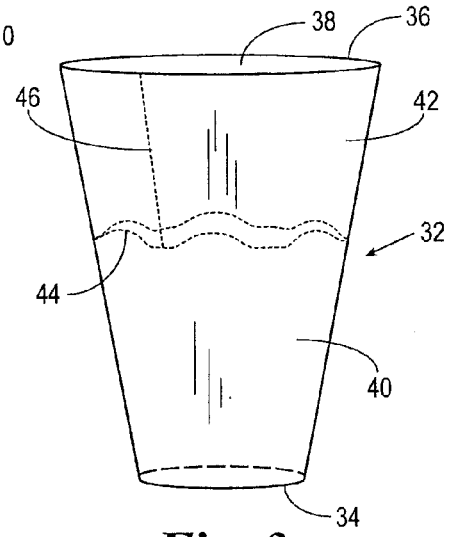
FIG. 3 is a perspective view of a floral sleeve having a detaching element defining a detachable upper portion and a lower portion of the sleeve.

Referring now to FIG. 3 shown therein is a sleeve 32 which, when disposed about the wrapper 18 containing the floral grouping 16, secures the wrapper 18 about the floral grouping 16 in a manner hereinafter described. The sleeve 32, also known as a tubular or floral sleeve, is preformed into the tubular shape and is provided with a lower end 34, an upper end 36 and a receiving space 38 extending therebetween. The configuration of the sleeve 32 can vary widely but generally will be tapered outwardly from the lower end 34 toward a larger diameter at the upper end 36. That is, the sleeve 32 will generally have a substantially frusto-conical configuration.

Figure 4:
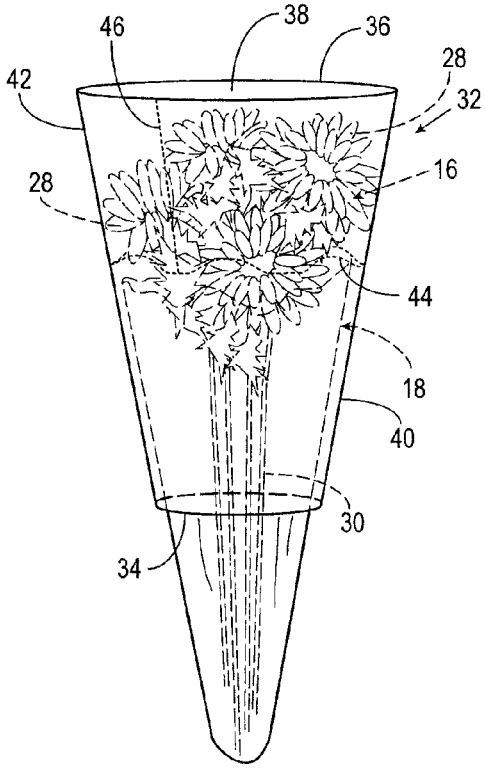
FIG. 4 is a pictorial representation of the floral sleeve of FIG. 3 disposed about the wrapper of FIG. 2 for securing the wrapper about the floral grouping.

The sleeve 32 is demarcated into a lower portion 40 and an upper portion 42 by a detaching element 44. The detaching element 44 which enables detachment of the upper portion 42 from the lower portion 40 of the sleeve 32 may have a non-linear pattern or shape substantially as shown in FIGS. 3 and 4 or a linear pattern or shape.

The detaching element can be any element, or combination of elements which permits the detachable upper portion 42 of the sleeve 32 to be removed from the lower portion 40 of the sleeve 32. Examples of such detaching elements include, but are not limited to, perforations, tear strips, zippers and any other devices or elements known in the art, or any combination thereof, which enables the detachment of the detachable upper portion 42 of the sleeve 32 from the lower portion 40 of the sleeve 32. As previously stated, the detaching element may have a linear or arcuate pattern as well as a non-linear pattern as shown.

To assist in the removal of the detachable upper portion 42 from the lower portion 40 of the sleeve 32, the sleeve 32 may also be provided with a substantially vertically disposed detaching element 46 which extends from the upper end 36 of the sleeve 32 to the detaching element 44. Thus, the substantially vertically disposed detaching element 46 cooperates with the detaching element 44 to remove the detachable upper portion 42 of the sleeve 32 in a manner which will be described in more detail hereinafter.

The sleeve 32 can be constructed of any material capable of being formed into a sleeve and the sleeve 32 can be provided with any size or configuration as long as the sleeve 32 can be disposed about the wrapper 18 and frictionally engage at least a portion of the wrapper 18 to secure the wrapper 18 about the floral grouping 16. For example, the sleeve 32 can be fabricated of paper (untreated and treated in any matter), metal foil, polymeric film, fabric (woven, non-woven, synthetic or natural), cardboard, fiber, cloth, burlap, or laminations and combinations thereof. Further, the material from which the sleeve 32 can be treated to render such material fluid impermeable by any well-known technique, if desired.

Any thickness of material may be utilized in the construction of the sleeve 32 as long as the sleeve 32 functions in accordance with the presently disclosed and claimed inventive concept(s) as described herein. Desirably, the material from which the sleeve 32 is constructed has a thickness in the range from about 0.1 mil to about 30 mil, and more desirably from about 0.5 mil to about 10 mil. The sleeve 32 may be constructed of a single layer of material or a plurality of layers of the same or different types of material. When employing layers of material in the construction of the sleeve 32, the layers of material may be connected together, laminated or may be employed as separate layers. Such materials used to construct the sleeve 32 are described in U.S. Pat. No. 5,111,637 entitled "Method For Wrapping A Flower Grouping", issued to Weder et al., on May 12, 1992, the entire contents of which are especially incorporated herein by reference.

The lower end 34 of the sleeve 32 may be open or closed; and the sheet of material 10 employed in the construction of the wrapper 18 can be fabricated of a fluid impermeable material or the material 10 can be treated to render the sheet of material fluid impermeable so that at least a lower portion of the sleeve 32 formed from the sheet of material 10 can be rendered fluid impermeable whereby a fluid, such as water, applied to the floral grouping 16 is retained within the confines of the wrapper 18 and/or the sleeve 32.

As shown in FIGS. 3 and 4, the sleeve 32 is open and the wrapper 18 containing the floral grouping 16 is disposed within receiving space 38 of the sleeve 32 whereby the lower portion 40 of the sleeve 32 frictionally engages the wrapper 18 so that the wrapper 18 is secured in a stable position about at least a portion of the stem end 30 of the floral grouping 16 by the lower portion 40 of the sleeve 32. That is the floral grouping 16 having the wrapper 18 disposed thereabout (i.e., the wrapped floral grouping) is disposed within the receiving space 38 of the sleeve 32 and the sleeve 32 is size such that, upon positioning the wrapped floral grouping in the receiving space 38 of the sleeve 32, the lower portion 40 of the sleeve 32 engages a portion of the wrapper 18 formed about the floral grouping 16 and frictionally engages the wrapper 18 to secure the wrapper 18 about the floral grouping 16. When the sleeve 32 is disposed about the wrapper 18 and the floral grouping 16, the upper portion 42 of the sleeve 32 encircles and protects the bloom end 28 of the floral grouping 16 while the lower portion 40 of the sleeve 32 encircles a portion of the wrapper 18 and secures the wrapper 18 in position about the floral grouping 16. It should be noted that in the embodiment shown in FIG. 4, the lower end 34 of the sleeve 32 is open.

Figure 5:
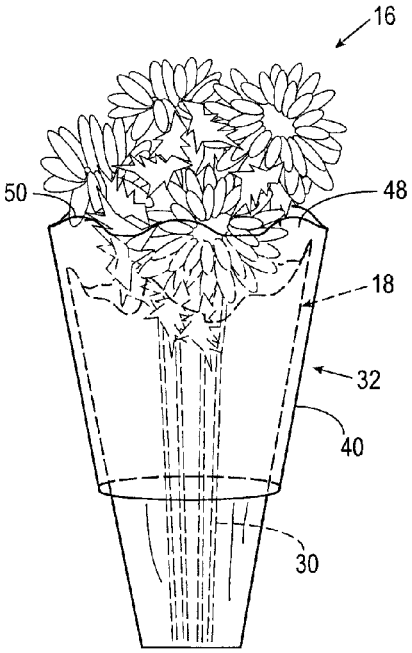
FIG. 5 is a pictorial representation of the floral sleeve disposed about the wrapper for securing the wrapper about the floral grouping of FIG. 4 wherein an upper portion of the sleeve has been detached.

As shown in FIG. 5, the upper portion 42 of the sleeve 32 has been removed while the lower portion 40 remains intact about the wrapper 18 and at least the stem end 30 of the floral grouping 16. It should be noted that when the upper portion 42 of the sleeve 32 is removed, the lower portion 40 of the sleeve 32 defines a skirt portion 48 having a non-linear upper peripheral edge 50. While the skirt portion 48 defined by the lower portion 40 of the sleeve 32 by the removal of the upper portion 42 of the sleeve 32 is shown as having the non-linear upper peripheral edge 50, it should be understood that the upper peripheral edge 50 of the skirt portion 48 can be substantially linear.

In operation, the sheet of material 10 is wrapped about the floral grouping 16 to provide the wrapper or cover 18 for the floral grouping 16. Once the wrapper 18 has been formed about the floral grouping 16, the sleeve 32 is opened so as to permit the floral grouping 16 having the wrapper 18 formed thereabout to be disposed within the receiving space 38 of the sleeve 32. The sleeve 32 is sized such that the sleeve 32 frictionally engages a portion of the wrapper 18 and secures the wrapper 18 about the floral grouping 16.

To remove the upper portion 42 of the sleeve 32 from the lower portion 40, the upper portion 42 of the sleeve 32 is torn along the detaching elements 44 and 46 whereby the upper portion 42 of the sleeve 32 is removed from the lower portion 40 and the lower portion 40 remains about the wrapper 18 formed of the sheet of material 10 and secures same about the floral grouping 16.

Figure 6:
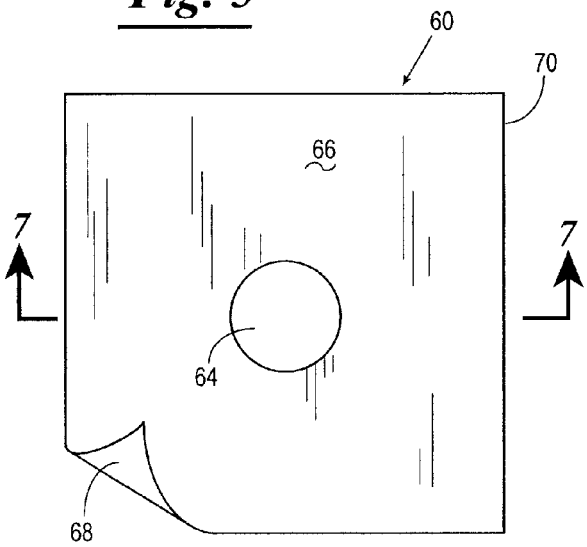
FIG. 6 is a top plan view of another embodiment of a sheet of material having a substantially square-shaped configuration used to form a wrapper about a floral grouping, the sheet of material having an opening therein adapted to receive at least a portion of a stem end of the floral grouping, one corner of the sheet of material being upwardly turned to show a lower surface of the sheet of material.

Referring now to FIG. 6 shown therein is another embodiment of a sheet of material 60 employed to form a wrapper 62 about the floral grouping 16. The sheet of material 60 is similar in construction to the sheet of material 10 hereto for described, except that the sheet of material 60 is provided with an opening or hole 64 formed through a portion of the sheet of material 60. More particularly, the opening or hole 64 is formed through a central portion of the sheet of material 60 and the opening or hole 64 intersects an upper surface 66 and lower surface 68 of the sheet of material 60. Further, the opening or hole 64 is spaced a distance from an outer periphery 70 of the sheet of material 60. While the opening or hole 64 is shown as being substantially centrally located within the sheet of material 60, it should be understood that the opening, or hole 64 can be offset relative to the center of the sheet of material 60 if desired.

Figure 7:
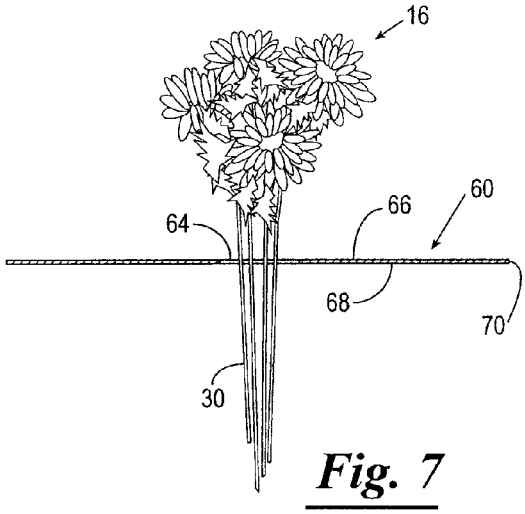
FIG. 7 is a cross-sectional view of the sheet of material of FIG. 6 taken along line 7-7 and having the stem of the floral grouping disposed through the opening thereof.
Figure 8:
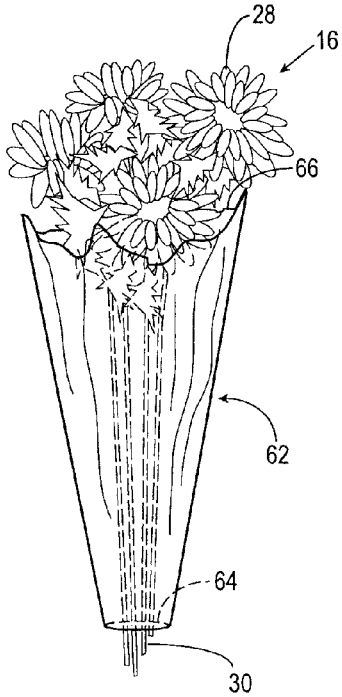
FIG. 8 is a pictorial representation of a floral grouping having a wrapper formed thereabout from the sheet of material of FIG. 6.

Referring now to FIG. 7, the stem end 30 of the floral grouping 16 is inserted through the hole or opening 64 to a position where at least a portion of the stem end 30 extends through the hole or opening 64 and extends a distance beyond the lower surface 68 of the sheet of material 60. The sheet of material 60 is then formed about the floral grouping 16 with the upper surface 66 of the sheet of material disposed near the floral grouping 16 and the wrapper 62 formed from the sheet of material 60 encompassing a substantial portion of the floral grouping 16 while a portion of the stem end 30 of the floral grouping 16 extend from the wrapper 62 substantially as shown in FIG. 8. Desirably, the wrapper 62 substantially encompasses the bloom end 28 of the floral grouping 16. However, it should be understood that the bloom end 28 of the floral grouping 16 can extend above the wrapper 62 as illustrated in FIG. 8.

Figure 9:
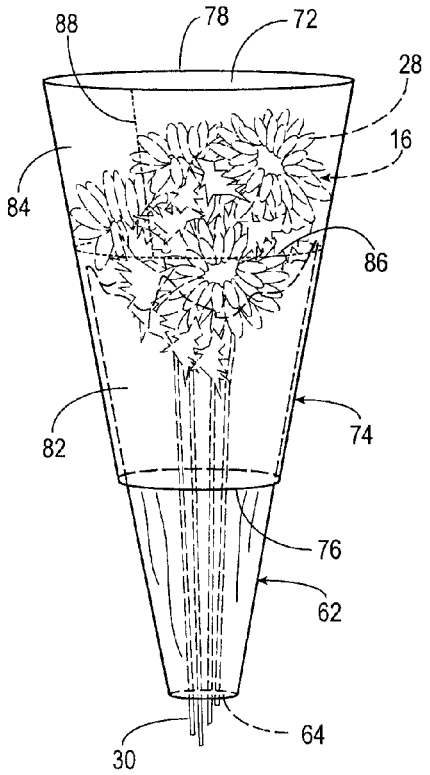
FIG. 9 is a pictorial representation of the floral sleeve of FIG. 3 disposed about the wrapper of FIG. 8, the sleeve securing the wrapper about the floral grouping.

The wrapper 62 is desirably tightly folded or wrapped about the stem end 30 of the floral grouping 16. To secure the wrapper 62 about the floral grouping 16, the wrapper 62 formed about the floral grouping 16 is disposed within a receiving space 72 of sleeve 74 substantially as shown in FIG. 9. The sleeve 74, which may also be referred to as a tubular sleeve or a floral sleeve, is provided with an open lower end 76, an open upper end 78 and the receiving space 72 is sized and configured to receive the floral grouping 16 having the wrapper 62 formed thereabout. The sleeve 74 is show as having a substantially frusto-conical configuration. That is, the sleeve 74 is tapered outwardly from the lower end 76 toward a larger diameter at the upper end 78 thereof. However, it should be understood that the sleeve 74 can be provided with any configuration as long as the sleeve 74 is provided with a receiving space 72 capable of receiving and retaining the wrapped floral grouping therein; and as long as at least a portion of the sleeve 74 is sized to frictionally engage the wrapper 62 disposed about the floral grouping 16 for securing the wrapper 62 about the floral grouping 16.

Figure 10:
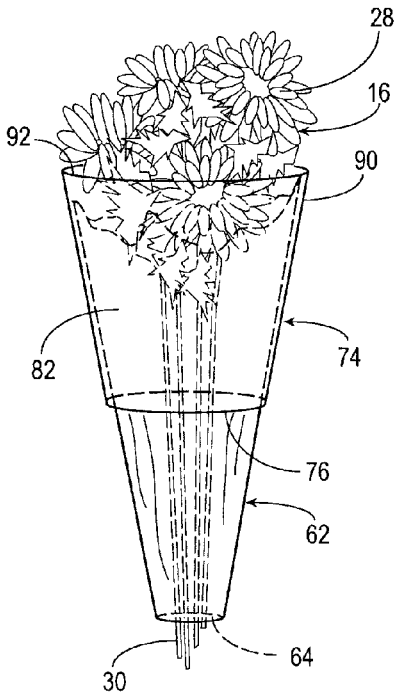
FIG. 10 is a pictorial representation of the sleeve disposed about the wrapper and floral grouping wherein the detachable upper portion of the sleeve has been detached.

The sleeve 74 is similar in construction to the sleeve 32, (i.e., the lower end 76 of the sleeve 72 is open) so that a lower portion of the stem end 30 of the floral grouping 16 can extend below the open lower end 76 of the sleeve 74 substantially as shown in FIGS. 9 and 10.

The sleeve 74 is demarcated into a lower portion 82 and an upper portion 84 by a detaching element 86. The detaching element 86, which enables detachment of the upper portion 84 from the lower portion 82, may have a substantially linear pattern or shape substantially as shown in FIG. 9, or a substantially non-linear pattern or shape as heretofore described with reference to FIG. 3.

To assist in the removal of the detachable upper portion 84 of the sleeve 74, the sleeve 74 may also be provided with a substantially vertically disposed detaching element 88 which extends from the upper end 78 of the sleeve 74 to the detaching element 86. Thus, the substantially vertically disposed detaching element 88 cooperates with the detaching element 86 to remove the detachable upper portion 84 of the sleeve 74.

As shown in FIG. 10, the upper portion 86 of the sleeve 74 has been removed while the lower portion 82 remains intact about the wrapper 62 and at least a portion of the stem end 30 of the floral grouping 16. It should be noted that when the upper portion 84 of the sleeve 74 is removed, the lower portion 82 of the sleeve 74 defines a skirt portion 90 having a substantially linear upper peripheral edge 92. While the skirt portion 90 defined by the lower portion 82 by the removal of the upper portion 84 of the sleeve 74 is shown as having a substantially linear upper peripheral edge 92, it should be understood that the upper peripheral edge 92 of the skirt portion 90 can be substantially non-linear.

The sleeve 74 can be constructed of any material capable of being formed into a sleeve and the sleeve 74 can be provided with any size or configuration as long as the sleeve 74 can be disposed about the wrapper 62 and frictionally engage at least a portion of the wrapper 62 to secure the wrapper 62 about the floral grouping 16. Thus, the sleeve 74 can be constructed of substantially the same materials as the sleeve 32; and the material used in the construction of the sleeve 74 can have a thickness substantially corresponding to the materials used in the construction of the sleeve 32.

If desired, a decorative pattern, such as a color and/or an embossed pattern and/or a hologram and/or other decorative surface ornamentation may be applied to the upper and/or lower surfaces 66 and 68 of the sheet of material 60 or portions thereof, including but not limited to, printed designs, embossed designs, coatings, colors, flocking or metallic finishes. Further, the sheet of material 60 may be totally clear or partially clear or a tinted transparent material.

Although the sheet of material 60 has been shown and described herein as having a substantially square-shaped configuration, it should also be understood that the sheet of material 60 may assume any geometric, non-geometric, asymmetrical or fanciful shape having any appropriate size so long as the sheet of material 60 can be disposed about the floral grouping 16 to form the wrapper 62. While the wrapper 62 has been described as being formed of one sheet of material 60, it should be understood that the wrapper 62 can be formed of two or more sheets of material 60. In addition, when employing two or more sheets of material 60 to form the wrapper 62, the configuration of the sheets of material 60 may vary depending on the overall design desired for the wrapper 62. For example, when using two sheets of material 60 to form the wrapper 62, the sheets of material 60 can have the same configuration, such as a square-shaped configuration, or the two sheets of material 60 can have different configurations, such as a square-shaped configuration and a rectangular-shaped configuration, and if desired, the two sheets of material 60 can be oriented differently relative to one another.

In operation, the stem end 30 of the floral grouping 16 is disposed through the hole or opening 64 of the sheet of material 60 and the sheet of material 60 is wrapped about the stem end 30 of the floral grouping 16 to provide the wrapper 62 which is folded or wrapped about the stem end 30 of the floral grouping 16. Once the wrapper 62 has been formed about the floral grouping 16, the sleeve 74 is opened and the floral grouping 16 having the wrapper 62 formed thereabout is disposed within the receiving space 72 of the sleeve 74. The sleeve 74 is sized such that the sleeve 74 frictionally engages a portion of the wrapper 62 and secures the wrapper 62 about the floral grouping 16.

To remove the upper portion 84 of the sleeve 74 from the lower portion 82, the upper portion 84 is torn along the detaching elements 86 and 88 whereby the upper portion 84 of the sleeve 74 is removed from the lower portion 82 and the lower portion 82 frictionally engages the wrapper 62 and secures the wrapper 62 about the floral grouping 16.

Figure 11:
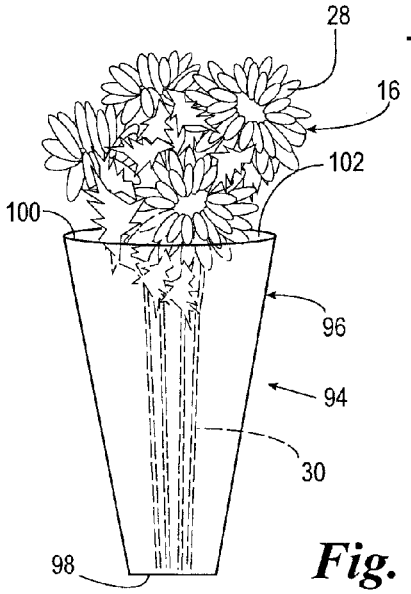
FIG. 11 is an elevational view of a bag disposed about a floral grouping to form a wrapper thereabout.
Figure 12:
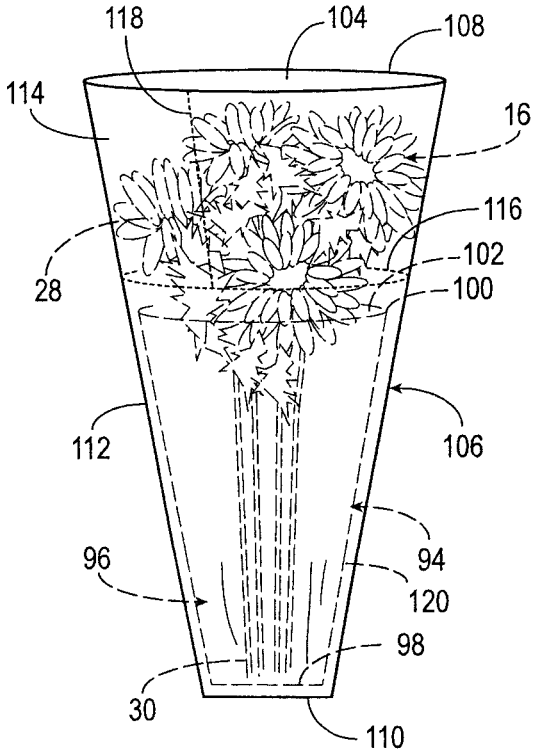
FIG. 12 is a pictorial representation of the floral sleeve of FIG. 3 disposed about the bag and the floral grouping for securing the bag about the floral grouping.
Figure 13:
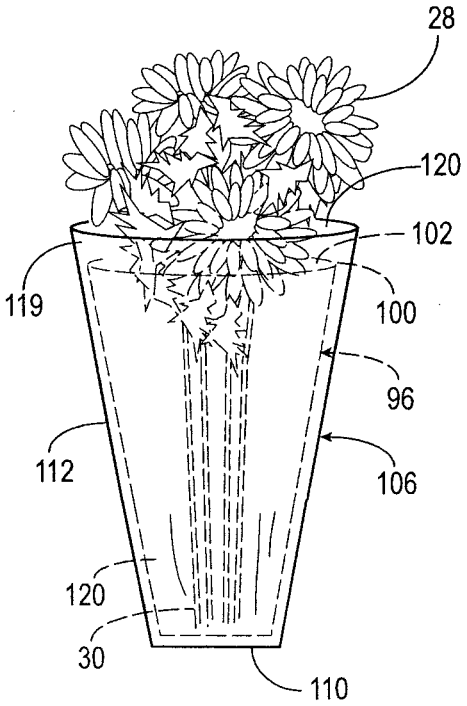
FIG. 13 is an elevational view of the floral sleeve of FIG. 12 disposed about the bag wherein the detachable upper portion of the sleeve has been detached.

Referring now to FIGS. 11-13 shown therein is a bag 94 sized and configured to form a wrapper 96 about at least the stem 30 of the floral grouping 16. The bag 94 is provided with a lower closed end 98, an open upper end, and a receiving space 102 extending there between. The bag 94 is wrapped about the stem end 30 of the floral grouping 16 to form the wrapper 94.

The material from which the bag 94 used to form the wrapper 96 is formed can be fabricated of any material having sufficient flexibility and structural integrity to provide the wrapper 96 and enclose at least the stem portion 30 of the floral grouping 16. To secure the wrapper 96 formed from the bag 94 about the stem end 30 of the floral grouping 16, the floral grouping 16 is disposed within the receiving space 102 of the bag 94 substantially as shown in FIG. 11. Thereafter, the wrapper 96 formed from the bag 94 is disposed within a receiving space 104 of a sleeve 106 substantially as shown in FIG. 12. The sleeve 106, which may also be referred to as a tubular sleeve or floral sleeve, is provided with an open upper end 108, a lower end 110 and the receiving space 104 which extends between the open upper end 108 and the lower end 110. In the embodiment shown in FIGS. 12 and 13, the lower end 110 of the sleeve 106 is shown as being a closed end. However, it should be understood that the sleeve 106 can be provided with an open end in the same manner as the sleeves 32 and 74 hereinbefore described with reference to FIGS. 3, 4, and 5 and FIGS. 9 and 10, respectively.

The sleeve 106 is sized and configured to receive the floral grouping 16 having the wrapper 96 formed thereabout from the bag 94. Further, the sleeve 106 is shown as having a substantially frusto-conical configuration. That is, the sleeve 106 is tapered outwardly from the lower end 110 toward a larger diameter at the open upper end 108 thereof. However, it should be understood that the sleeve 106 can be provided with any configuration as long as the sleeve 106 is provided with the receiving space 104 which is capable of receiving and retaining the wrapped floral grouping therein; and as long as at least a portion of the sleeve 106 is sized to frictionally engage the wrapper 96 formed from the bag 94 when the bag 94 is disposed about the floral grouping 16 for securing the wrapper 96 formed from the bag 94 about the floral grouping 16.

The sleeve 106 is similar in construction to the sleeves 32 and 72 hereinbefore described, except that the lower end 110 is closed as previously described.

Thus, the sleeve 106 is demarcated into a lower portion 112 and an upper portion 114 by a detaching element 116. The detaching element 116, which enables detachment of the upper portion 114 from the lower portion 112, may have a substantially linear pattern or shape substantially as shown in FIGS. 12 and 13 or a substantially non-linear pattern or shape as hereinbefore described with reference to FIG. 3.

To assist in the removal of the detachable upper portion 114 of the sleeve 106, the sleeve 106 may be provided with a substantially vertically disposed detaching element 118. Thus, the substantially vertically disposed detaching element 118 cooperates with the detaching element 116 in the removal of the detachable upper portion 84 of the sleeve 74.

In FIG. 13, the upper portion 114 of the sleeve 106 has been removed while the lower portion 112 remains intact about the wrapper 96 and at least the stem end 30 of the floral grouping 16. It should be noted that when the upper portion 114 of the sleeve 106 is removed, the lower portion 112 of the sleeve 106 defines a skirt portion 119 having a substantially linear upper peripheral edge 120. While the skirt portion 119 defined by the lower portion 112 by the removal of the upper portion 114 of the sleeve 106 is shown as having a substantially linear upper peripheral edge 120, it should be understood that the upper peripheral edge 120 of the skirt portion 119 can be substantially non-linear.

The sleeve 106 can be constructed of any material capable of being formed into a sleeve and the sleeve 106 can be provided with any size or configuration as long as the sleeve 106 can be disposed about the wrapper 96 formed from the bag 94 and at least a portion of the sleeve 106 frictionally engages at least a portion of the wrapper 96 to secure the wrapper 96 about the floral grouping 16. Thus, the sleeve 106 can be constructed of substantially the same materials as the sleeves 32 and 74 hereinbefore described; and the material used in the construction of the sleeve 106 can have a thickness substantially corresponding to the thickness of the materials used in the construction of the sleeves 32 and 74.

If desired, a decorative pattern, such as cutter and/or an embossed pattern and/or a hologram and/or other decorative surface ornamentation may be applied to an outer surface 120 of the bag 94 used to form the wrapper 96 about the floral grouping 16. Such ornamentation may include, but is not limited to, printed designs, embossed designs, coatings, colors, flocking or metallic finishes. Further, the bag may be made so as to be totally clear or partially clear or of a tinted transparent material.

In operation, the bag 96 is positioned about at least the stem end 30 of the floral grouping 16 to provide the wrapper 96 for the floral grouping 16. Once the wrapper 96 has been formed about the floral grouping 16, the sleeve 106 is opened so as to permit the floral grouping 16 having the wrapper 96 formed thereabout to be disposed within the receiving space 104 of the sleeve 106. The sleeve 106 is sized such that the sleeve 106 frictionally engages a portion of the wrapper 96 and secures the wrapper 96 about the floral grouping 16.

To remove the upper portion 114 of the sleeve 106 from the lower portion 112, the upper portion 114 of the sleeve 106 is torn along the detaching elements 116 and 118 whereby the upper portion 114 of the sleeve 106 is removed from the lower portion 112 and the lower portion 112 remains secured about the wrapper 96 formed from the bag 94 and secures same about the floral grouping 16.

While certain embodiments of a sleeve have been disclosed herein, including both open bottom and closed bottom sleeves, it is to be understood that any sleeve capable frictionally engaging a wrapper formed about the floral grouping can be employed for forming the wrapper about the floral grouping.

Changes may be made in the construction or operation of the various components, elements and assemblies described herein or in the steps or the sequence of steps of the methods described herein without departing from the spirit or scope of the presently disclosed and claimed inventive concept(s) as defined in the following claims.

What is claimed is:

1. A floral grouping package, comprising:

a floral grouping having a stem end;

a wrapper having an upper end, a lower end, and a floral grouping retaining space extending therebetween, the wrapper being disposed about at least a portion of the stem end of the floral grouping whereby at least a portion of the stem end of the floral grouping is encompassed by the wrapper and at least a portion of the floral grouping is disposed within the floral grouping retaining space of the wrapper, thereby forming a wrapped floral grouping; and a preformed sleeve having a receiving space and being tapered outwardly from a lower end toward a larger diameter at an upper end thereof, the wrapped floral grouping disposed in the receiving space of the preformed sleeve whereby at least a portion of the preformed sleeve frictionally engages a portion of the wrapper and secures the wrapper in a stable position about at least a portion of the floral grouping.

2. The floral grouping package of claim 1, wherein the wrapper is constructed of a material selected from the group consisting of paper, metal foil, polymeric material, cloth, burlap, and laminations and combinations thereof.

3. The floral grouping package of claim 1, wherein the wrapper comprises a substantially flat, flexible sheet of material.

4. The floral grouping package of claim 3, wherein the substantially flat, flexible sheet of material is a substantially square-shaped sheet of material having four corners, and wherein the four corners are flared and extend a distance outwardly and upwardly upon wrapping about the floral grouping.

5. The floral grouping package of claim 1, wherein the lower end of the wrapper is closed, and wherein the wrapper is formed of a fluid impermeable material.

6. The floral grouping package of claim 1, wherein the lower end of the wrapper is open, and wherein at least a portion of the stem portion of the floral grouping extends through the lower end of the wrapper.

7. The floral grouping package of claim 6, wherein the wrapper comprises a substantially flat, flexible sheet of material having an opening extending therethrough that forms the open lower end of the wrapper.

8. The floral grouping package of claim 7, wherein the substantially flat, flexible sheet of material is a substantially square-shaped sheet of material having four corners, and wherein the four corners are flared and extend a distance outwardly and upwardly upon wrapping about the floral grouping.

9. The floral grouping package of claim 1, wherein the preformed sleeve is constructed of a material selected from the group consisting of paper, metal foil, polymeric material, cloth, burlap, and laminations and combinations thereof.

10. The floral grouping package of claim 1, wherein the lower end of the preformed sleeve is open.

11. The floral grouping package of claim 1, wherein the lower end of the preformed sleeve is closed.

12. The floral grouping package of claim 1, wherein the preformed sleeve is further defined as having at least one detaching element provided therein for defining a detachable upper portion and a lower portion.

13. The floral grouping package of claim 12, wherein the lower portion of the preformed sleeve further comprises a skirt portion having a non-linear upper peripheral edge.

14. The floral grouping package of claim 13, wherein the skirt portion has a non-linear upper peripheral edge.

15. The floral grouping package of claim 12, wherein the detaching element of the sleeve is disposed adjacent an upper end of the wrapper.

* * * * *

UNITED STATES PATENT AND TRADEMARK OFFICE

CERTIFICATE OF CORRECTION

PATENT NO. : 8,931,212 B2
APPLICATION NO. : 13/965344
DATED : January 13, 2015
INVENTOR(S) : Donald E. Weder It is certified that error appears in the above-identified patent and that said Letters Patent is hereby corrected as shown below:

On the Title Page:
item (71) Applicant: After "U/T/A," insert -- dated Dec. 8, 1995 --

Signed and Sealed this
Ninth Day of June, 2015

Michelle K. Lee

Michelle K. Lee
*Director of the United States Patent and Trademark Office*